US006850203B1

(12) United States Patent
Schuneman et al.

(10) Patent No.: US 6,850,203 B1
(45) Date of Patent: Feb. 1, 2005

(54) DECADE BAND TAPERED SLOT ANTENNA, AND METHOD OF MAKING SAME

(75) Inventors: Nicholas A. Schuneman, Dallas, TX (US); James M. Irion II, Plano, TX (US); Richard E. Hodges, Corona, CA (US)

(73) Assignee: Raytheon Company, Waltham, MA (US)

( * ) Notice: Subject to any disclaimer, the term of this patent is extended or adjusted under 35 U.S.C. 154(b) by 66 days.

(21) Appl. No.: 10/023,800

(22) Filed: Dec. 14, 2001

Related U.S. Application Data

(60) Provisional application No. 60/317,410, filed on Sep. 4, 2001.

(51) Int. Cl.[7] ..... H01Q 13/10
(52) U.S. Cl. ..... 343/767
(58) Field of Search ..... 343/767–771, 343/795

(56) References Cited

U.S. PATENT DOCUMENTS

| | | | | |
|---|---|---|---|---|
| 4,843,403 A | | 6/1989 | Lalezari et al. | |
| 4,853,704 A | | 8/1989 | Diaz et al. | |
| 5,036,335 A | | 7/1991 | Jairam | |
| 5,081,466 A | | 1/1992 | Bitter, Jr. | |
| 5,185,611 A | | 2/1993 | Bitter, Jr. | 343/702 |
| 5,220,330 A | | 6/1993 | Salvail et al. | 342/62 |
| 5,519,408 A | | 5/1996 | Schnetzer | 343/767 |
| 6,008,770 A | | 12/1999 | Sugawara | |
| 6,222,494 B1 | | 4/2001 | Erkocevic | 343/790 |
| 6,229,683 B1 | | 5/2001 | Goodwin-Johansson | 361/233 |
| 6,317,094 B1 | * | 11/2001 | Wu et al. | 343/767 |
| 6,414,645 B1 | * | 7/2002 | Dahlberg | 343/767 |
| 6,452,124 B1 | | 9/2002 | York et al. | 200/181 |
| 6,538,614 B2 | | 3/2003 | Fleming et al. | 343/767 |
| 6,552,691 B2 | | 4/2003 | Mohuchy et al. | 343/770 |

FOREIGN PATENT DOCUMENTS

EP 0343322 11/1989

OTHER PUBLICATIONS

Chio, et al., "Large Wideband Dual–Polarized Array of Vivaldi Antennas with Radome", 1999 Asia Pacific Microwave Conference (Singapore), IEEE, Piscataway, New Jersey, Nov. 30, 1999, pp. 92–95.

U.S. Ser. No. 10/023,229, filed Dec. 14, 2001, entititled "Balun and Groundplanes for Decade Band Tapered Slot Antenna and Method of Making Same", inventors James M. Irion II, et al.

U.S. Ser. No. 09/946,848, filed Sep. 4, 2001, entitled "Method and Apparatus for Increasing Bandwidth of a Stripline to Slotline Transition", inventors James M. Irion II, et al.

U.S. Ser. No. 10/022,753, filed Dec. 14, 2001, entitled "Slot for Decade Band Tapered Slot Antenna, and Method of Making and Configuring Same", inventors Nicholas A. Schuneman, et al.

Schaubert, Daniel H., "Wide–Band Phased Arrays of Vivaldi Notch Antennas", Antenna Laboratory, University of Massachusetts, pp. 1.6 and 1.9–1.12, undated.

(List continued on next page.)

*Primary Examiner*—Michael C. Wimer
(74) *Attorney, Agent, or Firm*—Baker Botts L.L.P.

(57) ABSTRACT

An antenna apparatus (10) includes an antenna element (12, 412, 512) that has conductive material with a recess therein. The recess includes a balun hole (36, 536), and a tapered slot (37, 537) communicating at its narrow end with the balun hole. The balun hole is approximately rectangular, has a peripheral edge defined by conductive material, and contains air. The tapered slot has a shape which is optimized as a function of factors that include the balun hole design. Each slot edge follows a predetermined curve other than a first-order exponential curve.

31 Claims, 8 Drawing Sheets

OTHER PUBLICATIONS

Pickles, W.R., et al., "Ultra–Broadband Phased–Array Antenna", U.S. Naval Research Laboratory, pp. 1–6; undated.

Shin, Joon, et al., "A Parameter Study of Stripline–Fed Vivaldi Notch–Antenna Arrays", IEEE Transactions on Antennas and Propagation, vol. 47, No. 5, May 1999, pp. 879–886.

Chio, Tan–Huat, et al., "Parameter Study and Design of Wide–Band Widescan Dual–Polarized Tapered Slot Antenna Arrays", IEEE Transactions on Antennas and Propagation, vol. 48, No. 6, June 2000, pp. 879–886.

Kragalott, Mark, et al., "Design of a 5 : 1 Bandwidth Stripline Notch Array from FDTD Analysis", IEEE Transactions on Antennas and Propagation, vol. 48, No. 11, Nov. 2000, pp. 1733–1741.

Lee, Hai Fong, et al., "Advances in Microstrip and Printed Antennas", John Wiley & Sons, Inc., New York, 1997, two title pages and pp. 447–453 and 510–514.

Simon, K., "MMIC COmpensation Network for Phased Array Element Mismatch", Raytheon Company, Research Division, Sep. 14, 1990, 68 pages.

* cited by examiner

DECADE BAND TAPERED SLOT ANTENNA, AND METHOD OF MAKING SAME

This application claims the priority under 35 U.S.C. §119 of provisional application No. 60/317,410 filed Sep. 4, 2001.

GOVERNMENT RIGHTS

The U.S. Government has a paid-up license in this invention, and the right in limited circumstances to require the patent owner to license others on reasonable terms, as provided for by the terms of Contract No. MDA972-99-C-0025.

TECHNICAL FIELD OF THE INVENTION

This invention relates in general to tapered slot antennas and, more particularly, to a method and apparatus for obtaining wide band performance in a tapered slot antenna.

BACKGROUND OF THE INVENTION

During recent decades, antenna technology has experienced an increase in the use of antennas that utilize an array of antenna elements, one example of which is a phased array antenna. Antennas of this type have many applications in commercial and defense markets, such as communications and radar systems. In many of these applications, broadband performance is desirable. Some of these antennas are designed so that they can be switched between two or more discrete frequency bands. Thus, at any given time, the antenna is operating in only one of these multiple bands. However, in order to achieve true broadband operation, the antenna needs to be capable of satisfactory operation in a single wide frequency band, without the need to switch between two or more discrete frequency bands.

One type of antenna element that has been found to work well in an array antenna is often referred to as a tapered slot antenna element. The spacing between antenna elements in an array antenna is typically determined by the frequency at which the antenna operates, and a tapered slot antenna element fits comfortably within the space available for an antenna element in many array antennas.

Existing tapered slot antenna elements typically have a bandwidth of about 3:1 to 4:1, although some have a bandwidth that approaches 6:1. While these existing tapered slot antenna elements have been generally adequate for their intended purposes, they have not been satisfactory in all respects. In this regard, there are applications in which it is desirable for a tapered slot antenna element to provide broadband performance involving a bandwidth in the neighborhood of 10:1, or even larger. Existing designs and design techniques have not been able to provide a tapered slot antenna element which approaches this desired level of broadband performance.

SUMMARY OF THE INVENTION

From the foregoing, it may be appreciated that a need has arisen for a method and apparatus that contribute, in a tapered slot antenna element, to broadband performance exhibiting a substantially greater bandwidth than is available in pre-existing tapered slot antenna elements.

One form of the present invention involves: an electrically conductive layer having a recess therein which includes a balun portion and a slot portion, the slot portion communicating at one end with the balun portion; a dielectric layer disposed adjacent one side of the conductive layer, the dielectric layer having an opening therethrough in the region of a further end of the slot portion remote from the one end thereof; and an elongate conductive element which extends generally transversely with respect to the slot portion in the region of the one end thereof.

A different form of the present invention involves: an electrically conductive plate having a balun hole and a slot extending transversely therethrough, the slot opening at one end into the balun hole; and an elongate conductive element which extends generally transversely with respect to the slot in the region of the one end of the slot.

Still another form of the present invention involves: a conductive section having a recess which includes a balun portion and a slot portion, the slot portion communicating at one end with the balun portion, and having a further end remote from the one end thereof; an elongate conductive element which extends generally transversely with respect to the slot portion in the region of the one end thereof; and a refracting layer extending approximately perpendicular to a centerline of the slot portion at a location beyond the further end of the slot portion, the refracting layer being made of a material which is transmissive to and effects refraction of electromagnetic signals in a selected frequency range that travel in one of two opposite directions along the slot.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
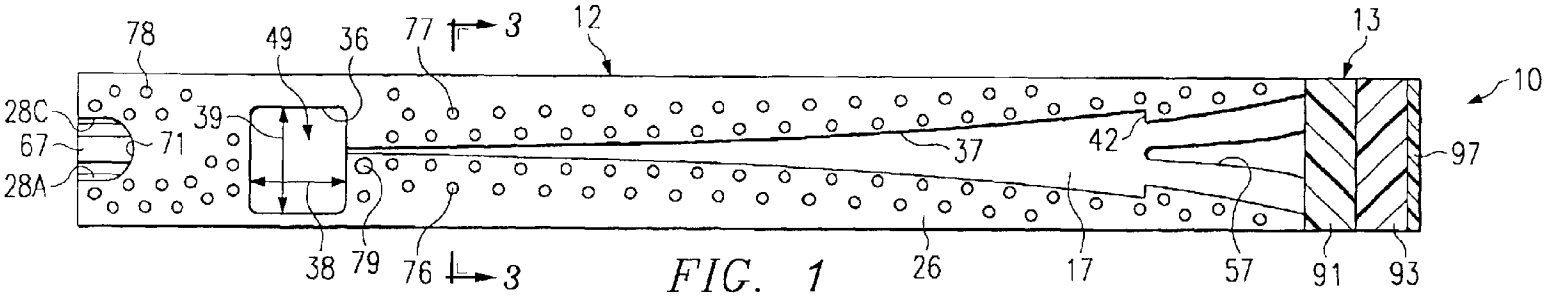
FIG. 1 is a diagrammatic fragmentary front view of an apparatus embodying aspects of the present invention, including an antenna element and part of a radome.

FIG. 1 is a diagrammatic fragmentary front view of an apparatus 10 which includes an antenna element 12 and part of a radome 13. In the disclosed embodiment, the apparatus 10 is configured for use in a not-illustrated phased array antenna system. The antenna system includes a plurality of the antenna elements 12 arranged in a two-dimensional array of rows and columns, and includes a radome which extends over all the antenna elements, a portion of this radome being shown at 13 in FIG. 1.

Figure 2:
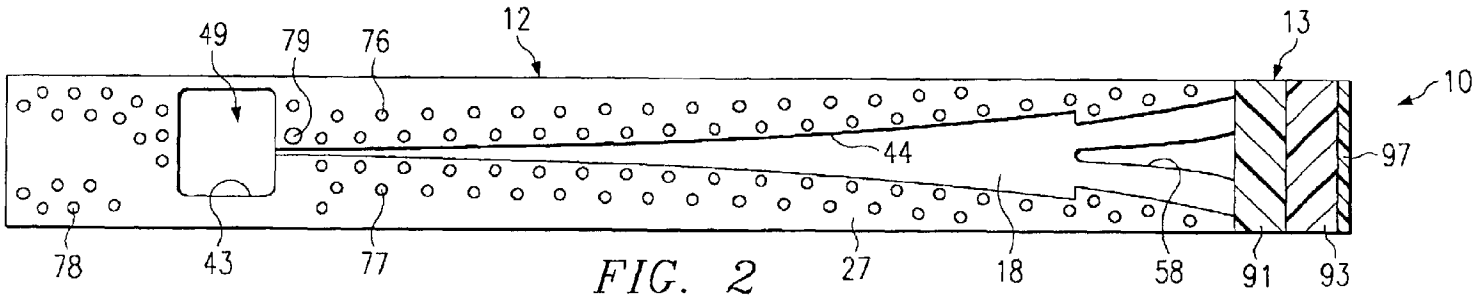
FIG. 2 is a diagrammatic fragmentary rear view of the apparatus 10.
Figure 3:
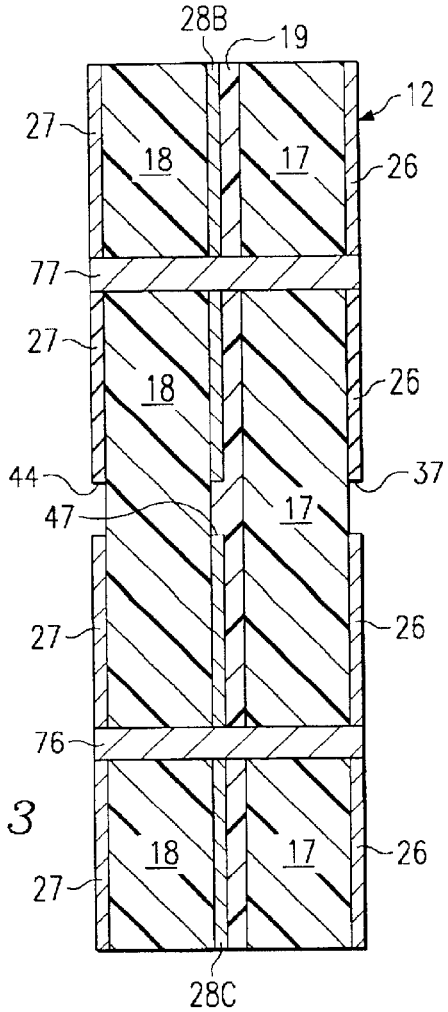
FIG. 3 is a diagrammatic sectional view taken along the section line 3—3 in FIG. 1.

FIG. 2 is a diagrammatic fragmentary rear view of the apparatus 10, and FIG. 3 is a diagrammatic sectional view taken along the section line 3—3 in FIG. 1. As best seen in FIG. 3, the antenna element 12 includes two adjacent and parallel layers 17 and 18 of a dielectric material. In this disclosed embodiment, the dielectric layers each have a dielectric constant (Er) of approximately 3.0. The dielectric layers 17 and 18 are bonded to each other by a thin layer. 19 of bond film, which is of a type well known in the art. The dielectric layers 17 and 18 are each approximately 20 mils thick. The bond film 19 is approximately 2–3 mils thick.

Figure 4:
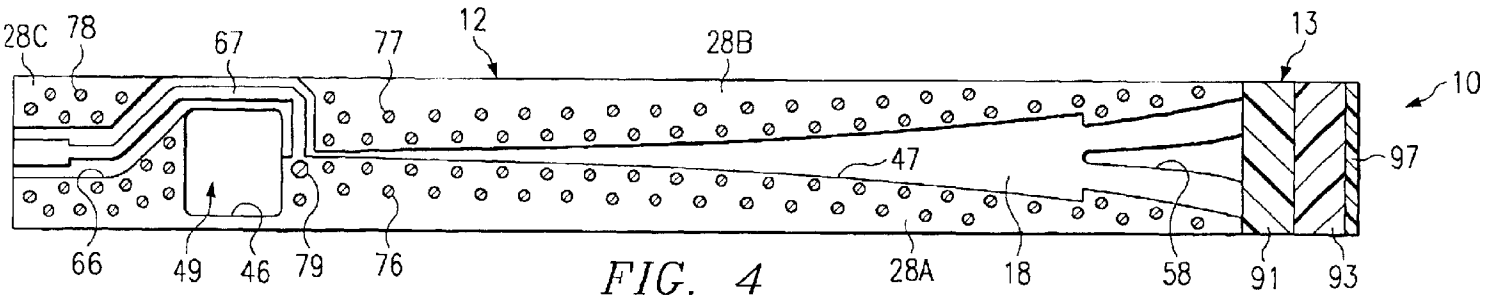
FIG. 4 is a diagrammatic fragmentary sectional front view of the apparatus of FIG. 1, taken along a center plane thereof.

FIG. 4 is a diagrammatic fragmentary sectional front view of the apparatus 10, taken along a central plane which extends between the dielectric layers 17 and 18, with the bond film 19 omitted for clarity. The dielectric layer 17 has on the front side thereof a first ground plane 26 (FIG. 1), the dielectric layer 18 has on the rear side thereof a second ground plane 27 (FIG. 2), and the dielectric layer 18 has on the front side thereof a third ground plane defined by three separate portions 28A, 28B and 28C (FIG. 4), which are sometimes referred to collectively herein as a ground plane 28.

The ground planes 26 and 27 are each electro-deposited metal layers with a thin gold plating on the outer side thereof to resist corrosion. The ground planes 26 and 27 each have an overall thickness which is approximately 1–2 mils. The ground plane 28 is an electro-deposited metal layer which is approximately 0.5–1 mils thick.

The ground plane 26 has a recess etched through it, and this recess includes a balun portion 36 and a slot portion 37. The balun portion 36 of the recess is approximately rectangular, except that it has corners which are slightly rounded. It has a length dimension 38, and a width dimension 39. In the disclosed embodiment, the length dimension 38 is one-quarter of a wavelength of interest. The embodiment of FIGS. 1–4 is optimized for use in a frequency range of approximately 1.8 GHz to 18 GHz, and the length dimension 38 is approximately one-quarter of the wavelength of a center frequency of about 10 GHz. The width dimension 39 in the disclosed embodiment is in the range of approximately one-quarter of this wavelength to approximately three-eighths of this wavelength. That is, the width dimension 39 is at least as large as the length dimension 38, but is kept somewhat short of one-half wavelength in order to avoid potentially undesirable operational characteristics.

In general, it is desirable that the width dimension 39 should be as large as possible within these stated constraints. As a practical matter, however, when the frequency of operation of a phased array antenna system progressively increases, the size of the array must progressively decrease, because the space available for each antenna element is approximately one-half of the wavelength of the highest frequency of operation. Thus, as the space available for each antenna element 12 progressively decreases, the maximum amount of space available for the width dimension 39 of the balun portion 36 also progressively decreases. Thus, in FIG. 1, the width dimension 39 is about 5% longer than the length dimension 38, but is not 50% to 70% longer, due to space limitations imposed by the operational frequency range of the antenna system.

Turning to the slot portion 37 of the recess in ground plane 26, the slot portion 37 has a narrow end which communicates with the balun portion 36 along one of the linear sides of the balun portion 36, at a location spaced from each end of that linear side. The opposite end of the slot portion 37 is significantly wider than the narrow end. The shapes of the edges of the slot portion 37 will be discussed in more detail with reference to FIG. 5.

Figure 5:
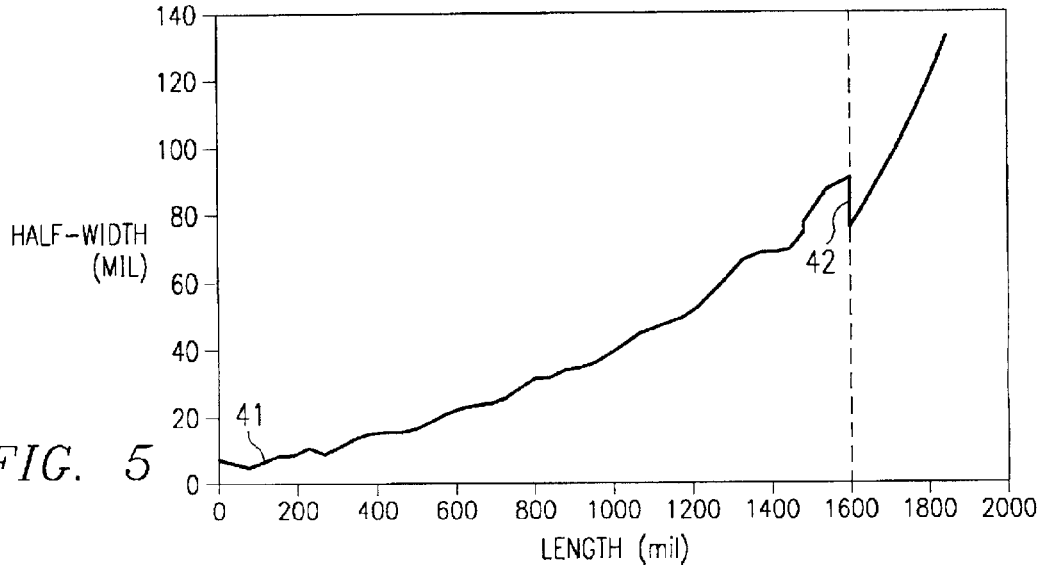
FIG. 5 is a graph showing the shape of one edge of a slot portion which is part of the antenna element of FIG. 1.

More specifically, FIG. 5 is a graph showing the shape of one edge of the slot portion 37, where the horizontal axis represents the centerline of the slot, from the end at the balun portion 36 to the end at the radome 13. The vertical axis in FIG. 5 represents the half-width of the slot, or in other words, the distance from the edge of the slot to the centerline. The edges of the slot portion 37 are mirror images of each other with respect to the centerline of the slot, and therefore only one of these edges is depicted in the graph of FIG. 5.

It will be noted from FIG. 5 that the edges of the slot portion 37 do not follow a pure first-order exponential curve. Instead, the slot edges have a shape which has been carefully configured to minimize reflections and reduce return loss in a manner facilitating a wide bandwidth in excess of 10:1. The technique used to configure the shape of the slot edge is described in detail later. For the moment, it is sufficient to note certain characteristics of the specific shape shown in FIG. 5 for the slot portion 37. More specifically, it can be seen that the narrowest part 41 of the slot portion 37 is not precisely at the end of the slot portion which opens into the balun portion 36, but instead is spaced a small distance from this end. This narrow part 41 provides a region of increased capacitance. Also, toward the opposite end of the slot portion 37, there is a significant discontinuity 42, which is discussed later. Further, each edge of the slot portion 37 is somewhat "wavy" in the section from the balun portion 36 to the discontinuity 42, which is not a random meandering, but instead is a carefully configured shape that reduces reflections and return loss in order to increase bandwidth and improve performance.

Roughly speaking, the curve shown in FIG. 5 might be described as approximately a first-order exponential curve that has at least one higher-order characteristics superimposed on the first-order characteristic, and in fact the particular curve of FIG. 5 has a number of higher-order characteristics superimposed on the first-order characteristic. In this regard, using well-known curve-fitting techniques, the specific curve shown in FIG. 5 can be expressed in the form of the following equation, where the coefficients for the equation are set forth in Table 1.

TABLE 1

$$\text{halfwidth}(x) \cong \frac{1}{2}\sum_{i=0}^{21} a_i x^i$$

COEFFICIENTS

| i | $a_i$ |
|---|---|
| 0 | 15.56616 |
| 1 | 3.540443 |
| 2 | −0.2724377 |
| 3 | 8.41E-03 |
| 4 | −1.46E-04 |
| 5 | 1.63E-06 |
| 6 | −1.25E-08 |
| 7 | 6.95E-11 |
| 8 | −2.88E-13 |
| 9 | 9.09E-16 |
| 10 | −2.23E-18 |
| 11 | 4.27E-21 |
| 12 | −6.46E-24 |
| 13 | 7.73E-27 |
| 14 | −7.30E-30 |
| 15 | 5.41E-33 |
| 16 | −3.11E-36 |
| 17 | 1.35E-39 |
| 18 | −4.32E-43 |
| 19 | 9.54E-47 |
| 20 | −1.30E-50 |
| 21 | 8.21E-55 |

Referring again to FIGS. 2 and 4, the ground plane 27 has therethrough a recess which includes a balun portion 43 and a slot portion 44, and the ground plane 28 has therethrough a recess which includes a balun portion 46 and a slot portion 47. The slot portions 37, 44 and 47 all have the same size and shape, in particular the shape described above in association with FIG. 5. Further, the slot portions 37, 44 and 47 are all precisely aligned with each other. In a similar manner, the balun portions 36, 43 and 46 all have the same size and shape, and are precisely aligned with each other. The dielectric layers 17 and 18 each have therethrough an approximately rectangular opening, which has the same size and shape as the balun portions 36, 43 and 46, and which is aligned with the balun portions 36, 43 and 46. Collectively, these aligned openings of approximately rectangular shape in the three groundplanes and the two dielectric layers define a balun hole 49 of approximately rectangular shape, which extends completely through the antenna element 12.

Figure 6:
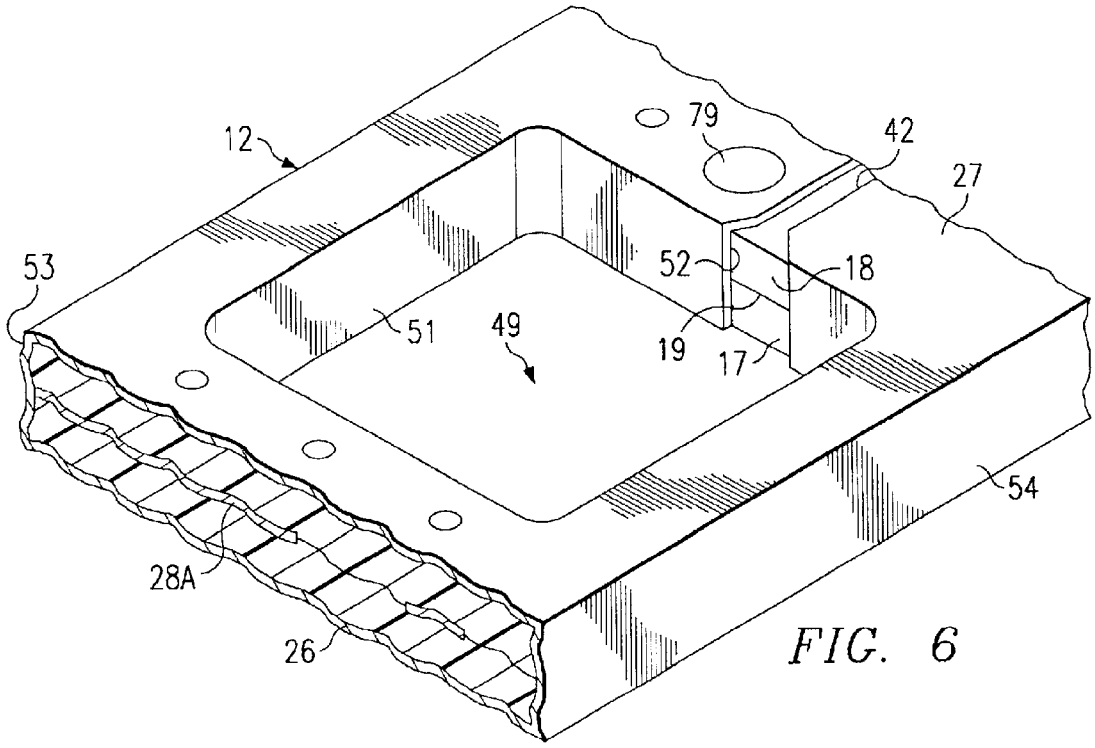
FIG. 6 is a diagrammatic fragmentary perspective view showing a portion of the rear side of the antenna element 12 in an enlarged scale.

FIG. 6 is diagrammatic fragmentary perspective view showing a portion of the rear side of the antenna element 12 in an enlarged scale. The balun opening 49 through the antenna element 12 is plated with an electrically conductive material, such that a strip 51 of this conductive material extends along the edges of the balun hole. The ends of the strip 51 are spaced so as to define a slot 52 aligned with the narrow ends of the slot portions 37, 44 and 47. The strip 51 extends between and is electrically coupled to the ground planes 26 and 27, and is also in electrical contact with the ground plane 28A.

The antenna element 12 also has its opposite side edges plated with an electrically conductive material, such that respective strips 53 and 54 of this conductive material extend the full length of the dielectric elements 17–18, and also extend between and are electrically coupled to each of the ground planes 26 and 27. The strip 53 is also in electrical contact with the ground plane 28A along its entire length, and the strip 54 is in electrical contact with each of the ground planes 28B and 28C.

The dielectric layers 17 and 18 have respective wedge-shaped openings 57 and 58 therethrough, which are identical size and shape and are aligned with each other. The openings 57 and 58 begin at the outer ends of the dielectric elements 17 and 18, and decrease progressively in width in a direction toward the balun hole 49. The tapering sides of the openings 57 and 58 are spaced inwardly from the tapering edges of the slot portions 37, 44 and 47. In a direction along the centerline of the slot portions 37, 44 and 47, the inner ends of the openings 57 and 58 are approximately aligned with the discontinuity 42 (FIG. 5). The discontinuity 42 compensates to some extent for an impedance discontinuity caused within the dielectric material by the start of the openings 57 and 58 at their left ends. The layer 19 of bond film (FIG. 3) has a wedge-shaped opening through it which is identical in size and shape to the openings 57 and 58, and which is aligned with the openings 57 and 58.

The ground plane 28 (FIG. 4) has, in addition to the recess which includes the balun portion 46 and the slot portion 47, a further recess 66 which is an elongate channel that extends from an inner end of the dielectric layer 18 around the balun portion 46, and opens into the narrow end of the slot portion 47. The channel 66 communicates along one side with the balun portion 46, but it would alternatively be possible for a portion of the groundplane 28A to extend between them.

An elongate conductive strip 67 extends through the channel 66, such that one end is disposed at the inner end of the dielectric layer 18 located at the left side of FIG. 1, and the other end extends across the narrow end of the slot portion 47 and is shorted directly to the ground plane 28A. The conductive strip 67 and the ground plane 28A are discussed herein as if they are physically separate parts, because they serve different operational functions in the antenna element 12. However, as a practical matter, the ground plane 28A and the conductive strip 67 are just different integral portions of the same conductive layer.

With reference to FIG. 1, an approximately semi-circular cutout 71 is provided through the ground plane 26 and the dielectric layer 17, in order to expose an end portion of the conductive strip 67, and an end portion of each of the portions 28A and 28C of the ground plane 28. This permits a contact of a not-illustrated connector arrangement to respectively engage the strip 67 and the ground plane portions 28A and 28C, in order to electrically couple the conductive strip 67 of the antenna element 12 to antenna system circuitry which is known in the art and therefore not shown in the drawings. In the case of the antenna element 12 shown in FIG. 1, the not-illustrated antenna system circuitry is electrically coupled to the arrangement of interconnected ground planes through direct engagement of a metal chassis of the antenna system with one or more of the outer ground planes 26–27 and the conductive strips 53–54.

The conductive strip 67 serves as a conductive element of the type which is commonly referred in the art as a stripline, and carries signals that are being transmitted from or received by the antenna element 12. The direct connection between the ground plane 28A and an end of the stripline 67 represents an electrical termination of that end of the stripline 67. Since the stripline 67 terminates directly into the groundplane 28, reactances are minimized where the stripline 67 extends across the slot portion 47, in comparison to pre-existing devices where the stripline is coupled by a via to a groundplane on the opposite side of a dielectric layer, or where the stripline terminates into some form of standalone termination structure designed to produce a standing wave resonance.

A plurality of vias extend through both of the dielectric layers 17 and 18 at a number of different locations, so as to electrically couple all three of the ground planes 26–28. Three of these vias are identified with reference numerals 76, 77 and 78. The vias facilitate precise control over impedance characteristics within the slot portions 37, 44 and 47 and along the stripline 67, and also help to reduce or eliminate the extent to which electromagnetic fields can form parallel plate and waveguide modes within the dielectric material. One of the illustrated vias is identified by reference numeral 79, and is slightly larger in diameter than the rest of the vias. The via 79 is disposed closely adjacent the point at which one end of the stripline 67 terminates directly into the ground plane portion 28A, and serves to ensure that this end of the stripline 67 is directly and reliably terminated to not only the center groundplane 28, but also the two outer groundplanes 26–27. It will be noted that a respective row of the vias extends adjacent each edge of the slot portions 37, 44 and 47, with approximately uniform spacing from each via to the edge of the slot portions, and with approximately uniform spacing between adjacent vias. Behind each of these rows, along most of the length thereof, is a further row of vias.

Figure 7:
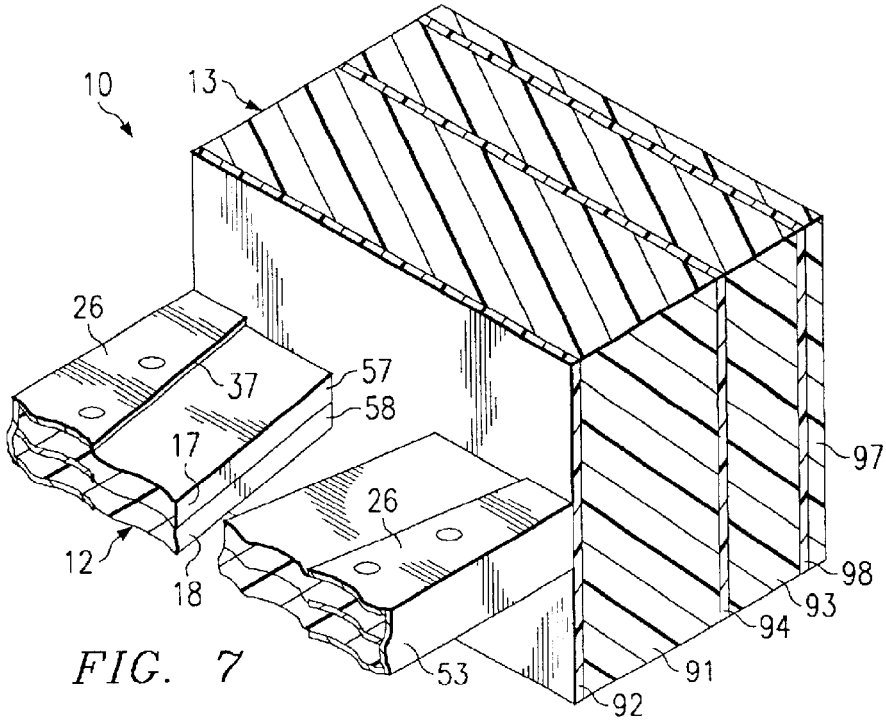
FIG. 7 is a diagrammatic fragmentary perspective view showing in an enlarged scale an outer end portion of the apparatus of FIG. 1.

FIG. 7 is a diagrammatic fragmentary perspective view of the outer end portion of the apparatus 10, in an enlarged scale. As best seen in FIG. 7, the radome 13 includes a dielectric layer 91 which is fixedly coupled to an outer end of the antenna element 12 by a bond film 92, a second dielectric layer 93 which is fixedly coupled to the dielectric layer 91 by a bond film 94, and a third dielectric layer 97 which is fixedly coupled to the dielectric layer 93 by a bond film 98. The bond films 92, 94 and 98 are materials of a type known in the art. The dielectric layer 97 is relatively thin, and serves primarily as a protective outer cover.

In the embodiment of FIG. 7, the dielectric layers 91, 93 and 97 have respective thickness of 120 mils, 60 mils and 2 mils, and have respective dielectric constants (Er) of 1.08, 1.3 and 3.6. Alternatively, the dielectric layers 91, 93 and 97 could have respective thicknesses of 60 mils, 120 mils and 2 mils, and respective dielectric constants of 1.3, 1.08 and 3.6. The dielectric layers 91 and 93 are transmissive to radiation which is being transmitted from or received by the antenna element 12. Further, the dielectric layers 91 and 93 effect a degree of refraction of this radiation, as discussed in more detail below. The dielectric layers 91 and 93 can also effect a small degree of impedance matching between the adjacent wide end of the slot portions located on one side thereof, and the free space located on the other side thereof.

In this regard, and with reference to FIG. 4, when an electrical signal is applied to the left end of the stripline 67, the signal travels through the stripline to its opposite end, where the stripline extends transversely across the slot portion 47. Here, the electrical signal generates an electromagnetic field around the stripline, which tends to try to travel in opposite directions within the "slotline" defined by the slot portions 37, 44 and 47. The slotline increases approximately progressively in impedance from the left end thereof toward the right end thereof, from an impedance of approximately 50 ohms in the region of the stripline 67 to an impedance of approximately 340 to 350 ohms at the wide outer end. The stripline 67 and the not-illustrated antenna system circuitry to which it is coupled are matched, so as to provide a substantial uniform impedance of approximately 50 ohms from the circuitry through the stripline 67 to the slotline. Free space beyond the right end of the apparatus 10 has an impedance of approximately 377 ohms, for a two-dimensional square unit cell representing uniform spacing in both directions of the two-dimensional array of antenna elements 12 within the phased array antenna system. The slotline effects an impedance transformation from a value of approximately 50 ohms at the left end, which is matched to the impedance of the stripline 67, to a value of approximately 360–370 ohms at the right end, which closely approaches the impedance of free space.

The use of three groundplanes 26–28 provides more conductive material along the edges of the slotline than in pre-existing arrangements that have only one or two groundplanes, which in turn provides increased capacitance within the slotline. The increased capacitance permits the narrow end of the slotline to be slightly wider than in pre-existing devices, while still achieving an impedance of 50 ohms which is matched to the impedance of the stripline 67. To the extent that the narrower end of the slotline can be wider, fabrication of the ground planes 26–28 is easier, due to the fact that tolerances involved in the etching techniques for the groundplanes are fixed.

The wedge-shaped openings 57 and 58 within the dielectric layers 17 and 18, and the congruent wedge-shaped opening within the bond film layer 19, help facilitate this impedance transformation, by reducing the amount of dielectric and bond film material disposed within the slotline at the right end thereof. Thus, at the right end of the antenna element 12, the impedance within the slotline will more closely approach the impedance of the free space located beyond the right end of the apparatus 10 than would be the case if the openings 57 and 58 were omitted and the right end of the slotline was completely filled with dielectric material. This is due to the fact that air has a somewhat higher impedance than the dielectric material, and the provision of the openings 57 and 58 substitutes air for what would otherwise be dielectric material.

As mentioned above, the balun hole 49 is designed so that the width dimension 39 (FIG. 1) is as large as possible in the region where the slotline opens into the balun hole 49, up to about three-eighths of a wavelength of interest. This is intended to provide the largest possible impedance discontinuity between the balun hole 49 and the narrow end of the slotline. This large discontinuity is facilitated by the fact that the slotline opens into the balun hole 49 through a side of the balun hole 49 which is approximately linear, and at a location spaced from both ends of this linear side.

In the disclosed embodiment, the balun hole has an impedance of approximately 300 ohms, which represents a relatively large discontinuity in relation to the 50 ohm impedance of the adjacent end of the slotline. As noted above, electromagnetic fields generated by the stripline 67 where it crosses the slotline will tend to want to travel in both directions along the slotline. However, the large impedance discontinuity between the balun hole 49 and the left end of the slotline will cause the majority of this electromagnetic energy to travel rightwardly rather than leftwardly along the slotline, and to be transmitted into free space. To the extent that a small portion of the electromagnetic energy travels leftwardly, the balun hole 49 has a length dimension which is approximately one-quarter wavelength (as discussed above), and this creates an open circuit standing wave which also tends to cause electromagnetic energy to travel rightwardly within the slotline.

As discussed earlier in association with FIG. 6, the inner edge of the balun hole 49 is plated with a conductive strip 51, except at the slotline. The strip 51 helps to keep electromagnetic fields present within the balun hole 49 from entering the dielectric material of layers 17 and 18, which helps to increase system bandwidth. Consequently, the strip 51 helps establish the standing wave or resonant condition with respect to electromagnetic energy within the balun hole 49, which in turn helps to direct electromagnetic energy rightwardly within the slotline. In a sense, the balun hole 49 is a tuned inductive hole, which can operate over a 10:1 bandwidth without electrical or structural adjustment.

In the disclosed embodiment, the balun hole 49 does not have any dielectric material within it. Thus, the balun hole 49 is filled with air, rather than dielectric material. For a given frequency, the wavelength of electromagnetic radiation is longer in air than it would be in dielectric material. Consequently, to the extent the balun hole 49 is made as wide as possible in order to maximize the impedance discontinuity between the balun hole and the adjacent end of the slotline, a given width will be further below one-half wavelength when the balun hole is filled with air than would be the case if the balun hole was filled with dielectric material.

When electromagnetic radiation reaches the right end of the antenna element 12, it passes through the radome 13 and is emitted into free space. As mentioned above, the dielectric layers 91 and 93 of the radome 13 impart a degree of refraction to this electromagnetic radiation. This refraction occurs with respect to wavefronts transmitted or received by the antenna system that are oriented at an angle with respect to the antenna system boresight, which is parallel to the centerlines of the slot portions of the antenna elements. Wavefronts which are perpendicular to the antenna system boresight, and thus perpendicular to the centerlines of the slot portions in the antenna elements, are not subject to refraction, or in other words can be viewed as undergoing refraction of 0°. The following discussion of refraction assumes that the wavefronts involved are oriented at an angle to the antenna system boresight and the centerlines of the clot portions of the antenna elements.

Figure 8:
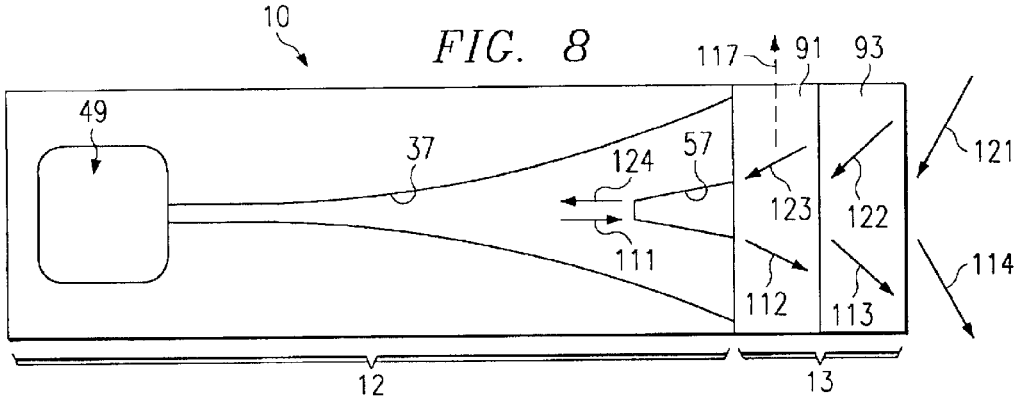
FIG. 8 is a highly diagrammatic view of the apparatus of FIG. 1, showing a refraction characteristic effected by certain dielectric layers in the radome thereof.

In this regard, FIG. 8 is a highly diagrammatic view of the apparatus 10, including both the antenna element 12 and the radome 13. Arrow 111 represents electromagnetic radiation which is traveling outwardly through the slotline. As this radiation passes through the interface between the antenna element 12 and the dielectric layer 91, it is refracted to a degree, so that it travels in a slightly different direction, as indicated diagrammatically in FIG. 8 by the arrow 112. Similarly, as this radiation passes through the interface between dielectric layer 91 and dielectric 93, it experiences a further degree of refraction which further increases its angle, as indicated diagrammatically by arrow 113. Then, as this radiation passes through the interface between dielectric layer 93 and free space, it is refracted a little further, so that it travels at a slightly greater angle, as indicated diagrammatically by arrow 114. This refraction within the radome 13 permits the apparatus 10 to operate more effectively over a wider scan angle, which in the disclosed embodiment approaches about 50° to 60°. In a sense, the refraction causes a portion of the radiation transmitted at each edge of the scan angle to have a higher effective power level than would be the case without such refraction.

The provision of the wedge-shaped openings 57 and 58 in the dielectric layer of the antenna element 12 permit the use of lower dielectric constants for the dielectric layers 91 and 93 of the radome 13 than would otherwise be the case. This in turn reduces the extent to which electromagnetic energy is diverted into transverse surface waves within the dielectric layers, for example as indicated diagrammatically by a broken line arrow 117, which in turn reduces or avoids an effect that is sometimes referred to as scan blindness.

Although the foregoing discussion of refraction was presented in the context of transmitted radiation, persons skilled in the art will recognize that received radiation is also subject to refraction. In FIG. 8, for example, reference numeral 121 diagrammatically represents radiation which is approaching the antenna element 12 at an angle to the centerline of the slot portions in the antenna element 12. As this radiation passes through the radome 13 and enters the antenna element 12, the radiation is progressively refracted, as indicated diagrammatically by arrows 122, 123 and 124, until the radiation is traveling through the slot portion of the antenna element 12 approximately parallel to the centerline.

Figure 9:
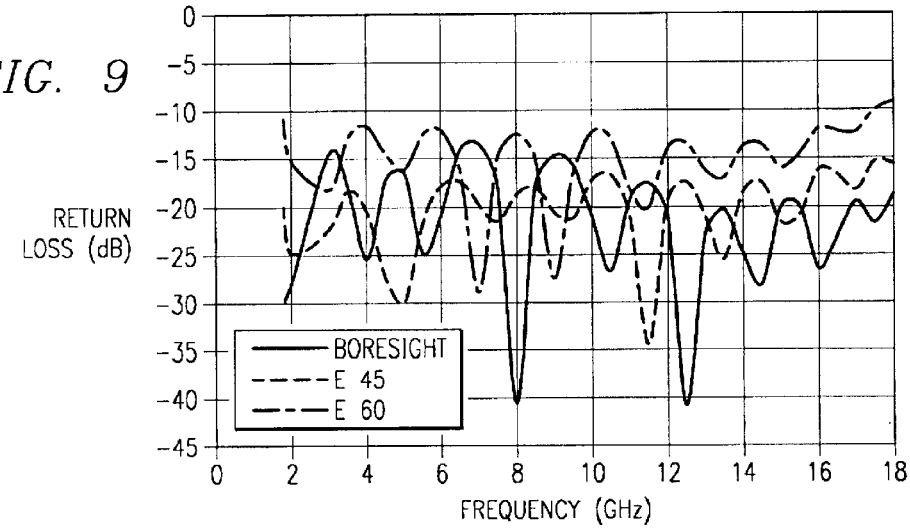
FIG. 9 is a graph showing return loss in E-plane scan as a function of frequency for the apparatus of FIG. 1.

FIG. 9 is a graph showing return loss as a function of frequency for the embodiment of FIGS. 1–8, for what is known in the art as E-plane scan. Since return loss is a standard way of expressing the amount of reflection, it is desirable that return loss be as low as possible. It will be noted that the apparatus 10 provides a return loss which is continuously below −10 dB for a scan width of 60° across a bandwidth from approximately 1.8 GHz to approximately 17.5 GHz. Persons skilled in the art will recognize that, expressed according to another industry standard, the embodiment of FIGS. 1–8 provides a bandwidth of at least 10:1 for −9.5 dB (VSWR less than 2).

Figure 10:
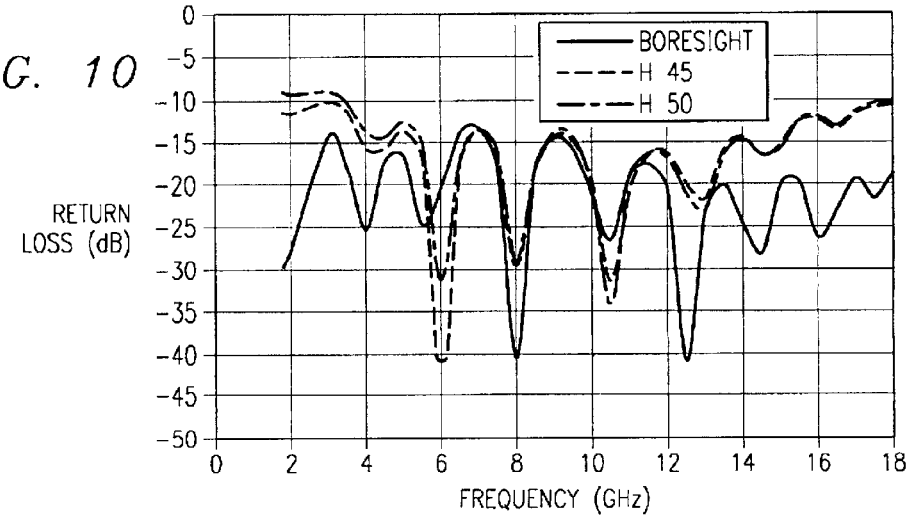
FIG. 10 is a graph showing return loss in H-plane scan as a function of frequency for the apparatus of FIG. 1.

FIG. 10 is a graph similar to FIG. 9, but showing return loss for what is commonly known in the art as H-plane scan. FIG. 10 shows that the apparatus 10 provides a return loss of −10 dB across a scan width of 45° to 50° from a frequency of about 3.5 GHz to a frequency in excess of 18 GHz.

Although the foregoing discussion has been presented primarily in the context of signals that are being transmitted by the apparatus 10 of FIG. 1, the apparatus 10 is equally suitable for use in receiving electromagnetic signals. Persons skilled in the art will understand from the foregoing discussion of signal transmission how the apparatus 10 would function for purposes of signal reception.

Advantageous performance characteristics, such as those reflected by FIGS. 9 and 10, are due in part to the shape determined for the edges of the slot portions 37, 44 and 47, which collectively serve as the slotline of the antenna element 12. An explanation will now be provided of how the shape for the edges of the slot portions is determined.

In this regard, and with reference to FIGS. 1 and 4, the apparatus 10 is conceptually broken into three functional sections for purposes of carrying out an analysis which determines an optimum shape for the edges of the slot portions. More specifically, one functional section is referred to as the balun, and corresponds roughly to the balun hole 49 and the conductive stripline 67. The next functional section is referred to as the slot, and corresponds roughly to the part of the slot portion which extends from the balun hole 49 to the discontinuity 42 at the left end of the wedge-shaped openings 57 and 58. The third functional section 203 is referred to as the end piece, and corresponds roughly to the part of the apparatus 10 located to the right of the discontinuity 42, in particular from the left end of the wedge-shaped openings 57–58 to the right side of the outer dielectric layer 97.

Figure 11:
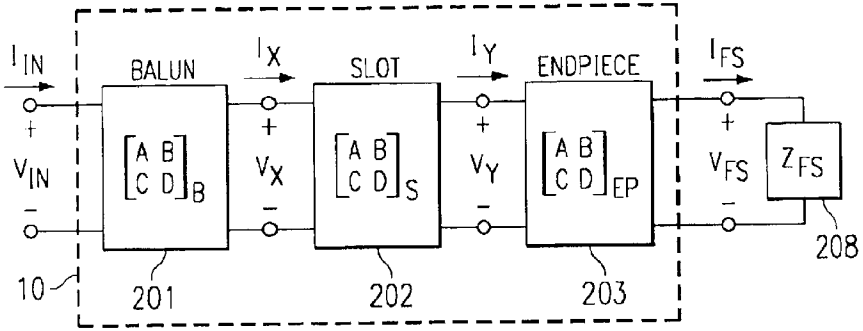
FIG. 11 is a block diagram showing functional sections of the apparatus of FIG. 1.

FIG. 11 is a diagram showing three blocks 201–203, which respectively represent the three functional sections discussed above, namely the balun, slot and end piece sections. Collectively, blocks 201–203 represent the apparatus 10 of FIG. 1, as indicated diagrammatically by a broken line in FIG. 11. Each of the blocks 201–203 is depicted as a two-port element, including one port with two terminals on the left side, and another port with two terminals on the right side. Adjacent ports of the adjacent blocks are coupled to each other. The end piece 203 has the port on the right side coupled to a further block 208, which diagrammatically represents the impedance of the free space disposed beyond the right end of the apparatus 10 in FIG. 1.

As is known in the art, two-port blocks such as those depicted at 201–203 can each be represented by what is commonly referred to as an [ABCD] matrix. For example, focusing on the block 202 in FIG. 11, which represents the slot, the left port has a voltage $V_x$ and current $I_x$ and the right port has a voltage $V_y$ and current $I_y$. The relationship between these ports can be expressed by the following equation, where the subscript "S" identifies the slot section:

$$\begin{bmatrix} V_X \\ I_X \end{bmatrix} = \begin{bmatrix} A & B \\ C & D \end{bmatrix}_S \begin{bmatrix} V_Y \\ I_Y \end{bmatrix}$$

Similarly, and still referring to FIG. 11, the overall transfer function for the apparatus 10 can be represented by a single [ABCD] matrix, as follows:

$$\begin{bmatrix} V_{IN} \\ I_{IN} \end{bmatrix} = \begin{bmatrix} A & B \\ C & D \end{bmatrix}_{APP} \begin{bmatrix} Y_{FS} \\ I_{FS} \end{bmatrix}$$

where $$\begin{bmatrix} A & B \\ C & D \end{bmatrix}_{APP} = \begin{bmatrix} A & B \\ C & D \end{bmatrix}_B x \begin{bmatrix} A & B \\ C & D \end{bmatrix}_S x \begin{bmatrix} A & B \\ C & D \end{bmatrix}_{EP}$$

and where the subscripts "APP", "B", "S" and "EP" respectively refer to the apparatus 10, the balun section 201, the slot section 202, and the end piece section 203.

Before attempting to determine an optimum shape for the edges of the slot, the balun and end piece (which correspond to blocks 201 and 203) are designed so as to achieve appropriate design goals. For example, as discussed above, the balun hole 49. (FIG. 1) has various aspects, such as shape, size and the absence of dielectric material, which are intended to achieve the design goal of a large impedance discontinuity between the balun hole and slotline, which in turn supports a wide bandwidth for the antenna element 12. Possible design configurations for both the balun and end piece can be rigorously analyzed with an existing software program to determine expected operational characteristics. One suitable software program for this task is available under the tradename High Frequency Structure Simulator (HFSS), and can be commercially obtained from Ansoft Corporation of Pittsburgh, Pa.

Once the physical design of the balun section and the end piece section have been completed, several appropriate [ABCD] matrixes are determined for each. In this regard, the apparatus 10 is designed for use across a frequency range of interest. The operational characteristics of the balun section will be different at different frequencies, and the operational characteristics of the end piece section will be different at different frequencies. Accordingly, several predetermined frequencies are selected, which are spread throughout the frequency range of interest. Then, a respective different [ABCD] matrix is determined for the balun section 201 for each selected frequency, and a respective different [ABCD] matrix is determined for the end piece section 203 for each such frequency.

Appropriate techniques for determining an [ABCD] matrix from a physical design are known in the art. As one example, parameters representing the physical design can be provided to a known software program, which can then calculate a form of transfer function known in the art as an [S] matrix. The HFSS computer program mentioned above is suitable for this task. Thereafter, the [S] matrix can be converted into a corresponding [ABCD] matrix, using known mathematical techniques.

Figure 12:
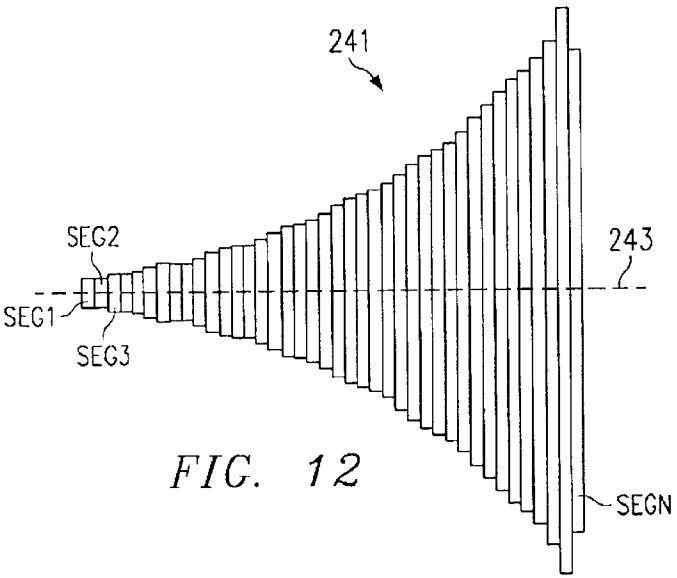
FIG. 12 is a diagrammatic view of a segmented transmission line which serves as a model for analyzing a slotline present in the apparatus of FIG. 1.

Turning to the slot section 202 of FIG. 11, one aspect of the present invention is the provision of a technique where the portion of the slotline corresponding to the block 202 is represented by a model which is a transmission line having the same size and shape as the slot, the transmission line being in the form of a number of contiguous transmission line segments. For example, FIG. 12 is a diagrammatic view of a model which is a transmission line 241, made up of a plurality of N contiguous rectangular segments SEG1, SEG2, SEG3, . . . SEGN. In FIG. 12 there are 40 segments, and thus N=40. The centerline of the slot is indicated diagrammatically at 243, and the outer ends of the N segments collectively represent the edges of the slot. The segments all have same length in a direction parallel to the centerline 243, but have a variety of different widths in a direction transverse to the centerline 243. The segments in FIG. 12 do not necessarily represent the precise slot shape shown in FIG. 5, but instead can be considered representative of one of a number of different shapes that are evaluated to determine which shape should serve as the optimum shape shown in FIG. 5.

In order to determine an optimum shape for the edges of the slot, the common length value for all of the segments SEG1 through SEGN and also the N respective width values are varied selectively and independently, and the performance of the apparatus 10 is evaluated for each such configuration of the segmented transmission line, in a manner explained in more detail below. It should be noted that the number N of segments is not varied. Consequently, to the extent that the common length value for the segments is varied, the overall length of the segmented transmission line, and thus the overall length of the slot it represents, will vary. Thus, part of what is optimized is the length of the slot itself.

Since the common length and the respective widths of the N segments are varied independently, the optimization process becomes progressively more complex and time consuming if the value of N is increased. As a result, competing considerations are involved in the selection of the value of N. In particular, it is desirable on one hand to have a relatively large value of N so that the ends of the segments provide good resolution in the definition of the slot edges. On the other hand, it is desirable to have a relatively small value of N in order to reduce the computational complexity involved in evaluating different configurations of the segmented transmission line model. For an antenna element of the type disclosed at 12 in the embodiment of FIGS. 1–8, it has been found that a value of N in the range of approximately. 40 to 60 provides a good balance between these two competing considerations.

Various existing techniques are known for effecting the independent variation of a number of parameters in a selective manner so as to optimize a specified characteristic. One such technique is commonly known in the art as the Nelder-Mead technique. There are commercially available software programs which implement the Nelder-Mead technique, one example of which is the program MATLAB® available from The MathWorks of Natick, Mass. Programs of this type provide generic Nelder-Mead capability, and can be provided with input data for a specific application which cause the program to apply the generic principles to that specific application. Since Nelder-Mead techniques are known in the art, they are not described in detail here. Instead, to facilitate an understanding of the present invention, a brief overview is provided.

In particular, a program which implements Nelder-Mead techniques is capable of varying multiple parameters in an intelligent manner according to Nelder-Mead principles, while evaluating a characteristic which is to be optimized. Generally speaking, configurations of parameters which tend to improve the specified characteristic are favored over configurations which do not improve the characteristic, and the favored configurations are used to predict other new configurations that may possibly provide even greater improvement in the specified characteristic.

In the context of the present invention, an initial slot shape is selected, for example where the edges of the slot simply follow a first-order exponential curve. Then, a segmented transmission line model of the type shown in FIG. 12 is used to model this initial slot shape, using N segments where N is roughly 40 to 60. The respective widths of the segments and also the common length of the segments are then independently varied using Nelder-Mead techniques in order to come up with a plurality of different configurations of the segmented transmission line, which each represent a different slot shape. For each such configuration, performance of that configuration is evaluated.

Figure 13:
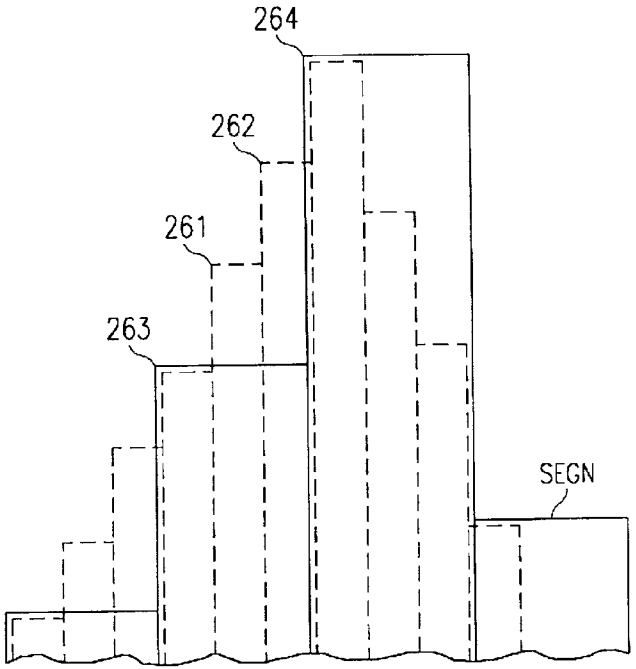
FIG. 13 is a diagrammatic view, in an enlarged scale, of the end portions of four of the transmission line segments of FIG. 12, and also shows in broken lines how the number of segments can be tripled through interpolation.

In this regard, in order to evaluate performance, the number of segments in the model is tripled through interpolation. For example, FIG. 13 is a diagrammatic view, in an enlarged scale, of the end portions of four of the transmission line segments shown in the upper right portion of FIG. 12. The solid lines in FIG. 13 correspond directly to the segments which are shown in FIG. 12. The broken lines in FIG. 13 show how the overall number of line segments is tripled from N to 3N. For example, two points 261 and 262 are identified through interpolation at uniformly spaced locations along a straight line extending between two points 263 and 264, which are at respective corners of two of the N segments shown in FIG. 12. Each of the points 261–264 then becomes a corner of a respective new segment having a length which is one-third the length of each of the N segments shown in FIG. 12. It should be noted that, although 3N segments are now available for purposes of evaluating performance, the Nelder-Mead techniques are not used to independently vary the widths of all 3N segments, but only the widths of the N segments shown in FIG. 12. The other two-thirds of the segments have widths that are directly dependent on the original N widths, rather than widths determined through completely independent variation.

Figure 14:
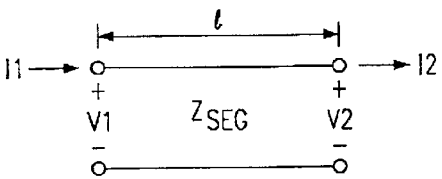
FIG. 14 is a diagrammatic view of one of the transmission line segments of FIG. 12, represented in theoretical form.

For a given configuration of 3N segments, for example as represented by broken lines in FIG. 13, the performance of the system is evaluated in the following manner. Each of the 3N segments is treated as a separate transmission line. With reference to FIG. 14, a theoretical transmission line has a length l, which corresponds to the uniform dimension of each of the 3N segments in a direction parallel to the centerline 243 (FIG. 12) of the slot. Further, the theoretical transmission line in FIG. 14 has an impedance $Z_{SEG}$ and, in the case of each of the 3N segments shown in FIG. 13, this impedance depends on one or more different factors. First, it depends on the width of the segment in a direction transverse to the centerline 243. Further, and with reference to the apparatus 10 shown in FIG. 1, it depends on whether there is material within the slot and, if so, the characteristics of that material.

For example, the embodiment of FIG. 1 has portions of the dielectric layers 17 and 18 which are disposed within the slot, and the dielectric layers have impedance characteristics that vary with frequency, even for a given width. In contrast, if the portions of the dielectric layers 17 and 18 located within the slot were removed, such that the slot was filled with air, the impedance characteristic would vary with width but not frequency, because the impedance of air does not vary with frequency.

As evident from FIG. 14, the theoretical transmission line can be modeled as a two-port element of the type discussed earlier, and its characteristics can thus can be represented by an [ABCD] matrix. In the case of one of the 3N rectangular segments shown in FIG. 14, the [ABCD] matrix for a particular lossless ideal segment would be defined as follows:

$$\begin{bmatrix} A & B \\ C & D \end{bmatrix}_{SEG} = \begin{bmatrix} \cos(\beta l) & jZ_{SEG}\sin(\beta l) \\ \frac{j\cdot\sin(\beta l)}{Z_{SEG}} & \cos(\beta l) \end{bmatrix}$$

where $$\beta = \frac{2\pi}{\lambda}$$

$$j = \sqrt{-1}$$

In these equations, it should be noted that the value of the wavelength λ can vary not only as a function of frequency, but also as function of the type of material present within the slot. For example, for a given frequency, the wavelength will be one value if there is dielectric material within the slot (as is the case in the embodiment of FIG. 1), but will be a different value if the slot contains air rather than dielectric material.

For a selected frequency, a respective [ABCD]matrix is determined for each of the 3N segments. Then, an [ABCD] matrix is determined for the entire segmented transmission line, as follows:

$$\begin{bmatrix} A & B \\ C & D \end{bmatrix}_S = \begin{bmatrix} A & B \\ C & D \end{bmatrix}_{SEG1} x \begin{bmatrix} A & B \\ C & D \end{bmatrix}_{SEG2} x \ldots x \begin{bmatrix} A & B \\ C & D \end{bmatrix}_{SEG3N}$$

Then, referring to FIG. 11, an [ABCD] matrix can be determined in the following manner for the entire apparatus of FIG. 1, identified by the subscript "APP", including the antenna element 12 and the radome portion 13.

$$\begin{bmatrix} A & B \\ C & D \end{bmatrix}_{APP} = \begin{bmatrix} A & B \\ C & D \end{bmatrix}_B x \begin{bmatrix} A & B \\ C & D \end{bmatrix}_S x \begin{bmatrix} A & B \\ C & D \end{bmatrix}_{EP}$$

Still referring to FIG. 11, it will be recognized that this [ABCD] matrix for the antenna element can be expressed in the following standard form:

$$\begin{bmatrix} V_{IN} \\ I_{IN} \end{bmatrix} = \begin{bmatrix} A & B \\ C & D \end{bmatrix}_{APP} x \begin{bmatrix} V_{FS} \\ I_{FS} \end{bmatrix}$$

This matrix equation can be rewritten in the form of two non-matrix equations, as follows:

$$V_{IN} = AV_{FS} + BI_{FS}$$

$$I_{IN} = CV_{FS} + DI_{FS}$$

where A, B, C and D are from $$\begin{bmatrix} A & B \\ C & D \end{bmatrix}_{APP}$$

Still referring to FIG. 11, and in particular to the block 208 at the right end thereof, it is well known that voltage equals current times impedance. Thus, $V_{FS}=I_{FS} \cdot Z_{FS}$. Substituting this into the two preceding equations for $V_{IN}$ and $I_{IN}$ yields the following:

$$V_{IN}=I_{FS}\,(AZ_{FS}+B)$$

$$I_{IN}=I_{FS}\,(CZ_{FS}+D)$$

where A, B, C and D are from $$\begin{bmatrix} A & B \\ C & D \end{bmatrix}_{APP}$$

Assume now that $Z_{SYS}$ represents the impedance of the entire system shown in FIG. 11, including both the apparatus 10 and the block 208, as viewed from the port at the left side of FIG. 11. It will be recognized that:

$$Z_{SYS} = \frac{V_{IN}}{I_{IN}} = \frac{AZ_{FS} + C}{CZ_{FS} + D}$$

where A, B, C and D are from $$\begin{bmatrix} A & B \\ C & D \end{bmatrix}_{APP}$$

As mentioned above, the antenna element 12 of FIG. 1 is coupled to a not-illustrated antenna system, for example through a cable. The antenna system supplies electrical signals to and from the input port at the left side of FIG. 11. Assume that $Z_0$ represents the characteristic impedance of the not-illustrated cable and other circuitry of the antenna system. It is customary in the art to design this circuitry and cable so that the impedances are all matched, to thereby provide a line of effectively constant impedance with no reflection. In the disclosed embodiment, this characteristic impedance $Z_0$ has a value of 50 ohms.

For a system of the type shown in FIG. 11, it is known in the art that the ratio of the reflected voltage to the incident voltage into the port can be expressed by the following equation:

$$R = \frac{Z_{SYS} - Z_0}{Z_{SYS} + Z_0}$$

It is also well known in the art that, using a reflection value R determined from the preceding equation, the associated return loss RL can be determined from the following equation:

$$RL=20\ \log_{10}(|R|)$$

The performance evaluation procedure discussed above is specific to a particular frequency. For a given slot shape, this evaluation needs to be carried out separately for each of a number of different frequencies spread across a frequency range of interest. This will result in a number of different values of return loss RL calculated for that particular slot shape at respective different frequencies, and these values of return loss RL can then be presented in the form of graph similar to FIGS. 9 and 10.

Further, the foregoing discussion has focused on how to evaluate one proposed slot shape. In order to come up with an optimum shape, a number of different slot shapes need to be evaluated in a similar manner, and the results of these evaluations are then compared in order to determine which slot shape provides the optimum performance. Various different criteria can be used to make this evaluation, and these criteria may be used either separately or in combination. Some examples of such criteria will now be discussed, but it should be recognized that the present invention is not limited to these particular criteria.

A first criteria involves a determination of the maximum value of return loss RL calculated for a given slot shape. The slot shape having the lowest maximum value of RL could be selected as the optimum design. Alternatively, all evaluated slot shapes with a maximum value of return loss RL lower than a specified value (such as −10 dB) could be identified, and the shapes in this group could then be comparatively evaluated using other criteria.

A second criteria would be to determine the maximum value, for each slot shape, of the absolute value of the calculated reflection R. The slot design with the lowest such maximum value could be selected as the optimum design. Alternatively, all evaluated slot shapes for which this calculated maximum value is less than a specified value could be selected, and the slot shapes in this group could then be comparatively evaluated using other criteria.

The two criteria discussed above tend to focus on any single point maximum for the reflection R or the return loss RL. Other criteria could take more of an averaging approach to performance, across the frequency range of interest. For example, a third criteria would be to sum the absolute values of reflection R calculated at various frequencies for a given slot design, as follows:

$$\sum_{f=f_{\min}}^{f_{\max}} |R_f|$$

A fourth criteria, which is a variation of the third criteria, would be to sum the squares of the absolute values of reflection R calculated at various frequencies for a given slot shape, as follows:

$$\sum_{f=f_{\min}}^{f_{\max}} |R_f|^2$$

Figure 15:
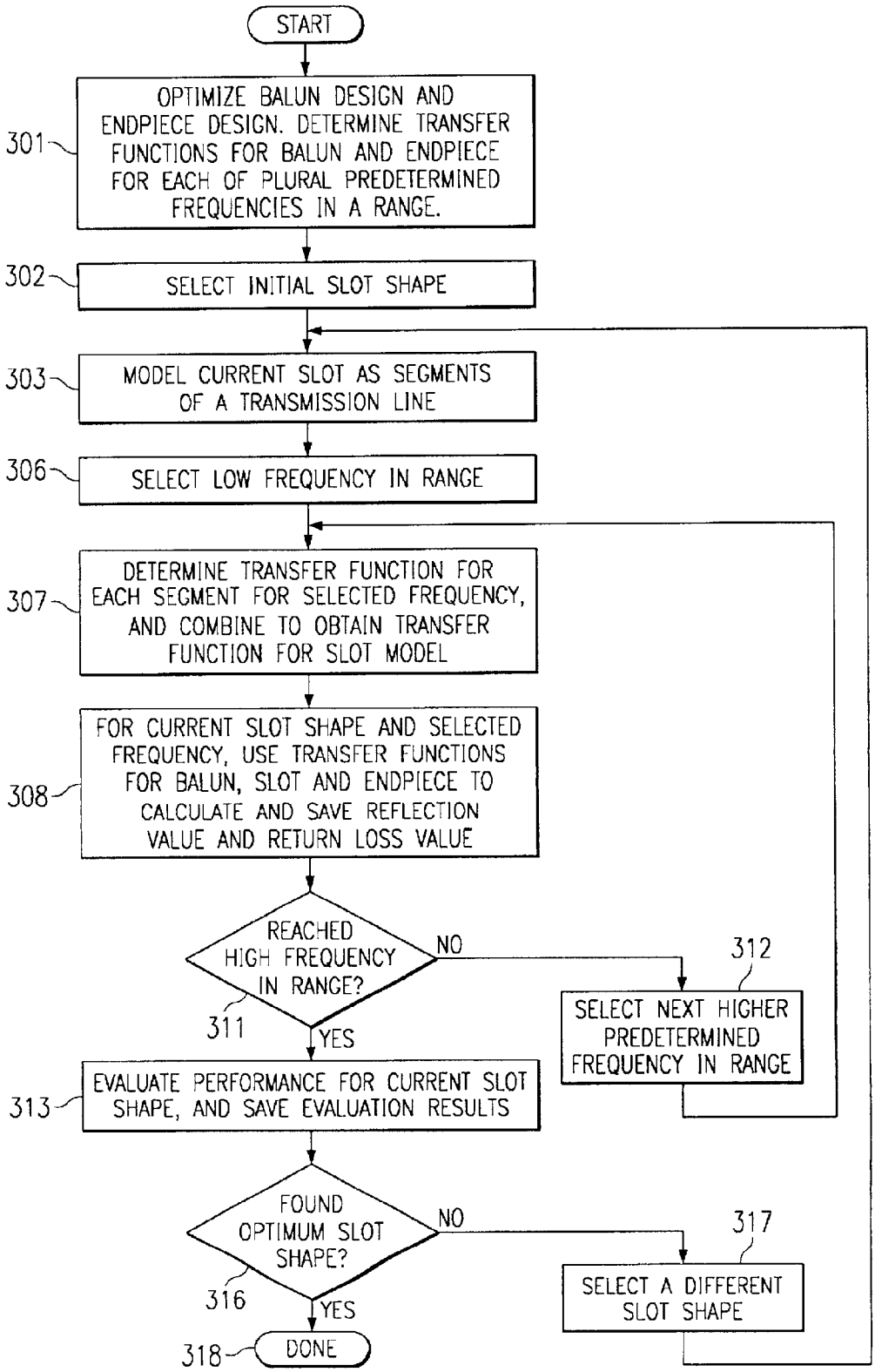
FIG. 15 is a flowchart which summarizes an optimization technique used in designing the apparatus of FIG. 1.

FIG. 15 is a flowchart, which summaries the optimization technique discussed above. More specifically, in block 301, the designs of the balun and end piece are each optimized and finalized. Then, transfer functions are determined for each of the balun and end piece at each of a plurality of predetermined frequencies spread across a frequency range of interest. As discussed above, each of these transfer functions can be represented in the form of an [ABCD] matrix.

Next, at block 302, an initial slot shape is selected in order to "seed" the optimization routine. In the disclosed embodiment, the initial slot shape is selected to be a pure first-order exponential curve, but it would alternatively be possible to use some other initial slot shape. Next, at block 303, the selected slot shape is modeled as a segmented transmission line, in the manner discussed above in association with FIGS. 12 and 13. Then, at block 306, the lowest of the predetermined frequencies in the range is selected.

Next, at block 307, a respective transfer function is determined at the selected frequency for each of the segments of the segmented transmission line. In the disclosed embodiment, each such transfer function can be in the form of an [ABCD] matrix, as discussed above. These various transfer functions for the different segments are then combined to obtain a single transfer function for the entire segmented transmission line. In the disclosed embodiment, this is also an [ABCD] matrix, as discussed above.

Control then proceeds from block 307 to block 308. For the current slot shape and the selected frequency, the transfer functions for the balun section, slot section and end piece section are used to calculate and save a reflection value and a return loss value, in a manner discussed previously. Then, at block 311, a determination is made of whether the currently selected frequency is the highest frequency in the range. If not, the next highest of the predetermined frequencies is selected at block 312, and control returns to block 307 to analyze the performance of the current slot design at this newly-selected frequency.

In contrast, if it is determined at block 311 that the current slot shape has been evaluated for all predetermined frequencies in the range, control proceeds to block 313, where all of the reflection values and return loss values for the current slot shape are used to evaluate the performance of the system for that slot shape. These evaluations are then saved.

Next, at block 316, an evaluation is made of whether the optimum shape has been found. This determination involves use of performance criteria of the type discussed above. Further, it depends on the extent to which the Nelder-Mead techniques discussed above have reached a point where a variety of different slot shapes have been evaluated and it appears that the optimum shape is likely to be a shape that has already been evaluated, rather than a shape that has yet been evaluated. In general, a number of slot shapes will be evaluated before a decision is made at block 316 that the optimum slot shape has been identified.

When a determination is made in block 316 that an optimum slot shape has not yet been located, control proceeds to block 317, where a new and different slot shape is selected for evaluation, through variation of the widths of the N segments and/or the common length of the N segments. The blocks 316 and 317 basically represent a particular application for the known Nelder-Mead techniques that were discussed earlier. In contrast, if at some point it is determined at block 316 that an optimum slot shape has been determined, the evaluation process is finished, and ends at block 318.

Figure 16:
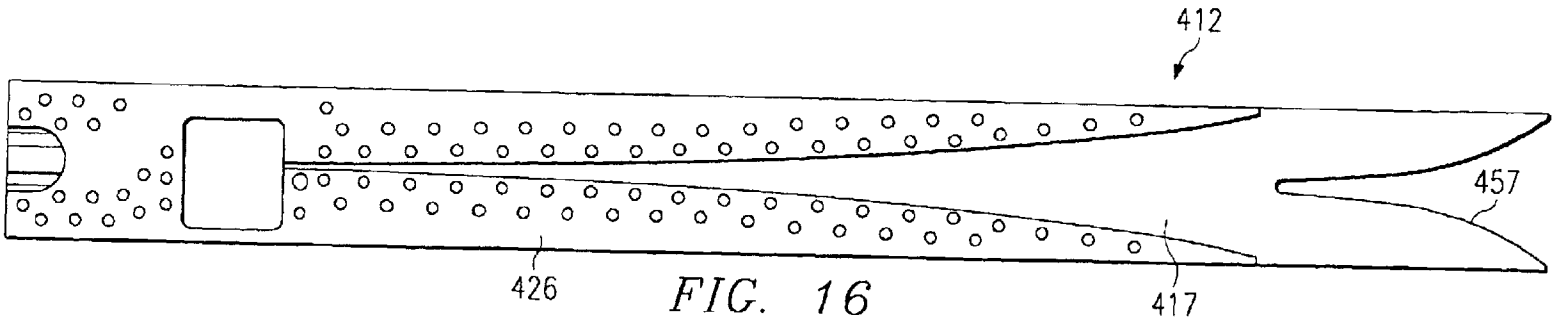
FIG. 16 is a diagrammatic front view of an antenna element which is an alternative embodiment of the antenna element of FIG. 1.

FIG. 16 is a diagrammatic front view of an antenna element 412 which is alternative embodiment of the antenna element 12 of FIG. 1. The antenna element 412 of FIG. 16 would normally be used with a radome of the type shown at 13 in FIG. 1, but the radome is omitted from FIG. 16. The antenna element 412 of FIG. 16 is substantially identical to the antenna element 12 of FIG. 1, except for the differences which are discussed below.

More specifically, the two dielectric layers and the bond film of the antenna element 412 each extend outwardly beyond the ends of the three ground planes, one of the dielectric layers being visible at 417, and one of the ground planes being visible at 426. The upper and lower side edges of the antenna element 412 each have plating which extends from the left end of the antenna element to the right ends of the ground planes. This edge plating does not extend the rest of the way to the right end of the antenna element 412.

The dielectric layers each have a wedge-shaped opening therein, one of which is visible at 457. It will be noted that the left end of each wedge-shaped opening is located rightwardly of the right ends of the ground planes, including the ground plane 426. In other words, the wedge-shaped openings in the dielectric layers are not disposed within the slotline defined by the slots in the ground planes. Consequently, the edges of the slot portions in the antenna element 412 do not have a discontinuity comparable to that shown at 42 in FIG. 1, because the discontinuity 42 is due to the fact that the wedge-shaped opening 57 in FIG. 1 is disposed within the slotline.

Although it is not readily visible in FIG. 16, the edges of the slot portions of the ground planes do not follow a first-order exponential curve, but instead have higher-order effects which give them a somewhat wavy shape, in a manner similar to that described above in association with the embodiment of FIG. 1. The procedure used to determine the shape of the slot edges for the embodiment of FIG. 16 is similar to the procedure described above for the embodiment of FIG. 1, and is therefore not described again in detail here. Further, the operation of the embodiment of FIG. 16 is similar to the operation of the embodiment of FIG. 1, and is therefore not explained again in detail here.

Figure 17:
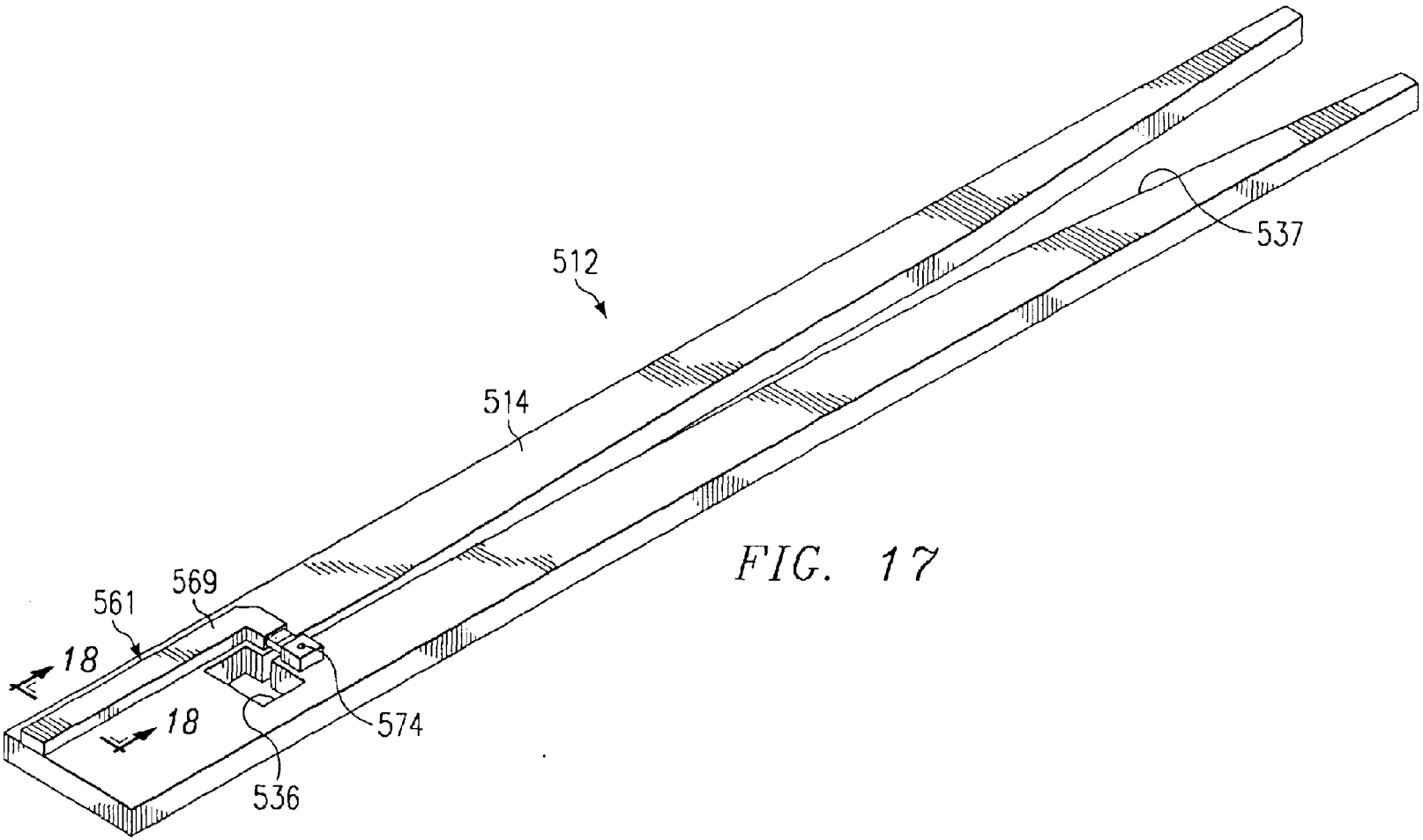
FIG. 17 is a diagrammatic perspective view of an antenna element which is still another alternative embodiment of the antenna element of FIG. 1.

FIG. 17 is a diagrammatic perspective view of an antenna element 512 which is a further alternative embodiment of the antenna element 12 of FIG. 1. The antenna element 512 includes a body 514 which is made from a single metal plate. A recess is provided through the metal plate, and includes a balun portion 536 in the shape of a rectangular hole, and an elongate slot portion 537 which communicates at its narrow end with the balun portion 536. In general, the balun portion 536 and the slot portion 537 have sizes and shapes that are comparable to those discussed above in association with the embodiment of FIG. 1. In this regard, the edges of the slot portion 537 do not follow merely a first-order exponential curve, but instead include higher-order effects which give the edges a somewhat wavy shape. The shape of the edges is determined by a procedure similar to that discussed above in association with the embodiment of FIG. 1, and this procedure is not described again in detail here.

One significant difference is that the slot portion 537 contains air rather than a dielectric material. The effects of having air in the slot portion, rather than a dielectric material, have already been discussed above in detail. The antenna element 512 includes a coaxial stripline 561, which has an electrically conductive exterior sheath that is fixedly secured to the front of the plate 514 by a conductive epoxy adhesive of a known type.

Figure 18:
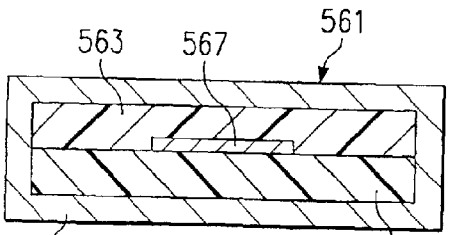
FIG. 18 is a diagrammatic sectional view taken along the section line 18—18 in FIG. 17.

FIG. 18 is a diagrammatic sectional view of the coaxial stripline 561, taken along the section line 18—18 in FIG. 17. As shown in FIG. 18, the coaxial stripline 561 includes two adjacent dielectric layers 563 and 564, with a conductive stripline 567 disposed between them. Along most of its length, the stripline 567 has a width which is substantially less than the width of the dielectric layers 563 and 564, so that the dielectric layers 563 and 564 serve as a layer of insulating material which extends coaxially around the stripline 567.

A sheath 569 of an electrically conductive material extends completely around the dielectric layers 563 and 564. As mentioned above, the sheath 569 is physically and electrically coupled to the metal plate. 514 in FIG. 17 by a conductive epoxy adhesive of a known type, which is not separately shown in the drawings.

Figure 19:
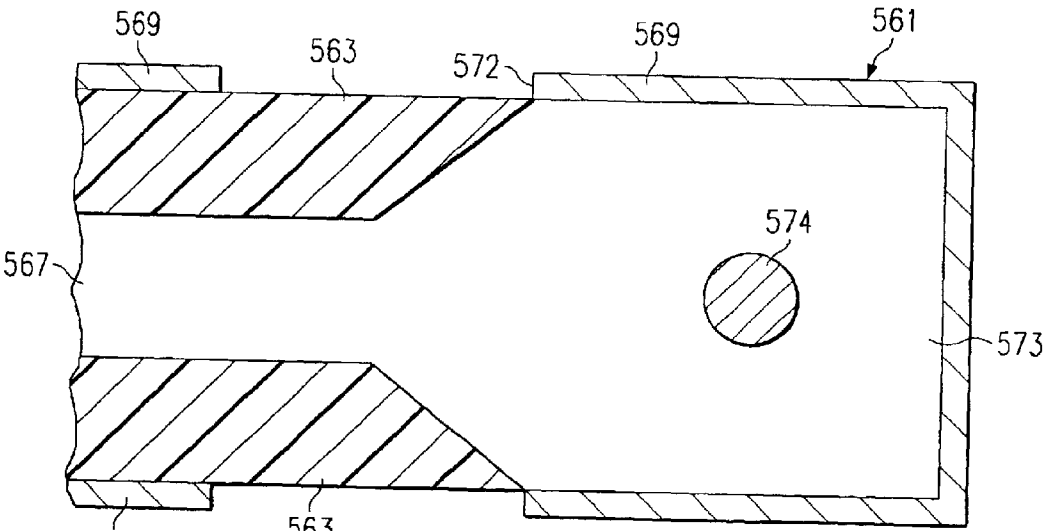
FIG. 19 is a diagrammatic fragmentary sectional top view of a coaxial stripline which is a component of the antenna element of FIG. 17.

FIG. 19 is a diagrammatic fragmentary sectional top view of the coaxial stripline 561, taken along a plane defined by the top surface of the stripline 567, and showing an end portion of the coaxial stripline 561 which is located in the region of the narrow end of the slot portion 537 (FIG. 17). With reference to FIGS. 17 and 19, the conductive sheath 569 has an annular gap 572 which extends completely around the coaxial stripline 561. The gap 572 is aligned with the slot portion 537, and permits current within the stripline 567 to generate electromagnetic fields that can escape the sheath 569 and extend into the slot portion 537.

Approximately halfway across the gap 572, the stripline 567 begins expanding progressively in width, which serves as a transition to an approximately rectangular end portion 573, three sides of which electrically engage the sheath 569. A via at 574 extends through the conductive stripline between opposite sides of the sheath 569, and is electrically coupled to the end portion 573 of the stripline 567. Thus, in effect, the end of the stripline 567 is shorted directly to a ground plane defined by the metal plate 514 (FIG. 17), in order to effect electrical termination of the stripline 567.

One technique for fabricating the coaxial stripline 561 is as follows. The dielectric material 564 is fabricated, and then a layer of metal is deposited on top of it. The metal layer is then photolithographically etched in a known manner, in order to remove selected portions of it, such that the remaining portions define the stripline 567 with its end portion 573. Then, the dielectric layer 563 is formed over the dielectric layer 564 and the stripline 567. Next, a cylindrical hole is created through the dielectric layers and the metal layer, at a location where the via 574 is to be formed. Then, this arrangement is immersed in an electroless plating tank, in order to form the sheath 569 over the entire exterior thereof, and in order to form the via 574 within the cylindrical hole. The annular mask prevents conductive material from being plated within the region of the gap 572. After the plating is completed, the mask is removed in order to expose the gap 572. The resulting assembly is then secured to the metal plate 514, using a conductive epoxy adhesive, as discussed above.

The operation of the antenna element 512 of FIGS. 17–19 is generally similar to that of the antenna element 12 of FIG. 1. Therefore, a separate detailed discussion of the operation of the antenna element 512 is believed to be unnecessary, and is omitted here.

The present invention provides a number of technical advantages. One such technical advantage results from the provision of a cutout or recess in the dielectric material located within the wide end of the slot. This recess facilitates impedance matching between the antenna element and structure or free space disposed beyond the outer end of the antenna element. It can also help to reduce or avoid surface wave scan blindness within a radome present at the outer end of the antenna element. A related advantage results where the slot is approximately wedge-shaped, so as to facilitate a smooth and progressive change in impedance.

Another advantage is realized where the antenna element is implemented with a solid piece of metal which has therein a recess defining both the balun hole and the slot. An advantage of this arrangement is that it avoids the presence of dielectric material within the slot, which in turns reduces the extent to which there may be an impedance discontinuity between the wide end of the slot and material or free space which is disposed beyond the outer end of the antenna element. Further, it can reduce the cost of the antenna element, by permitting the main portion of the antenna element to be rapidly and cheaply produced by a technique such as a precision die-stamping operation, or a fine blanking technique.

Another technical advantage is realized where a radome provided at the outer end of the antenna element has at least one layer which has an impedance selected to effect a degree of refraction of electromagnetic energy that is passing through the radome in a direction other than directly along the boresight. This serves to increase the efficiency with which signals at wide scan angles are transmitted and received, which in turn permits the antenna element to have a wider effective scan angle. A related advantage results from the provision of multiple layers within the radome which successively and progressively effect refraction of electromagnetic energy.

Although selected embodiments have been illustrated and described in detail, it will be understood that various substitutions and alterations are possible without departing from the spirit and scope of the present invention, as defined by the following claims.

What is claimed is:

1. An apparatus, comprising:

an electrically conductive layer having a recess therein which includes a balun portion and a slot portion, said slot portion communicating at one end with said balun portion;

a dielectric layer disposed adjacent one side of said conductive layer, said dielectric layer having an opening therethrough in the region of a further end of said slot portion remote from said one end thereof; and an elongate conductive element which extends generally transversely with respect to said slot portion in the region of said one end thereof.

2. An apparatus according to claim 1, wherein said opening increases substantially progressively in width in a direction away from said one end of said slot portion.

3. An apparatus according to claim 2, wherein said opening is disposed along a centerline of said slot portion and is positioned so that at least a portion of said opening is on a side of said further end of said slot portion nearest said one end thereof, said portion of said opening being spaced from edges of said slot portion.

4. An apparatus according to claim 2, wherein said opening is disposed along a centerline of said slot portion and is positioned beyond said further end of said slot portion.

5. An apparatus, comprising:

an electrically conductive plate having a balun hole and a slot extending transversely therethrough, said slot opening at one end into said balun hole;

an elongate conductive element which extends generally transversely with respect to said slot in the region of said one end of said slot; and wherein said slot has edges on opposite sides thereof that each follow a predetermined curve other than a first-order exponental curve and that may be represened by a polynominal having an order greater than one.

6. An apparatus according to claim 5, wherein said plate is made of a metal.

7. An apparatus according to claim 5, wherein said conductive element has first and second ends, said conductive element being electrically coupled to said plate at said second end thereof, and being free of electrical contact with said plate from said first end thereof to a section thereof adjacent said second end thereof, said section of said conductive element being the portion thereof which extends generally transversely of said slot in the region of said one end of said slot.

8. An apparatus according to claim 7, including a dielectric sheath provided around said conductive element from said first end thereof past said section thereof; and including an electrically conductive shield provided around said sheath from said first end of said conductive element to a location adjacent said section thereof, said sheath being free of said shield in the region of said section of said conductive element, and said shield being electrically coupled to said plate.

9. An apparatus according to claim 8, wherein said sheath extends to said second end of said conductive element;

including a further shield which is provided around said sheath at said second end of said conductive element and which is electrically coupled to said plate; and including structure which electrically couples said second end of said conductive element to said further shield.

10. An apparatus according to claim 9, wherein said structure includes said conductive element increasing in cross-sectional dimension from said section thereof toward said second end thereof so that said second end thereof extends outwardly through said sheath and electrically contacts said further shield.

11. An apparatus according to claim 9, wherein said structure includes a via extending between opposite sides of said further shield through said second end of said conductive element.

12. An apparatus according to claim 5, wherein said slot has edges on opposite sides thereof which each follow a predetermined curve other than a first-order exponential curve.

13. An apparatus according to claim 5, wherein said predetermined curve for each said edge is configured to facilitate minimization of return loss for electromagnetic signals induced within said slot portion through said elongate conductive element.

14. An apparatus according to claim 5, wherein said slot has a further end remote from said one end thereof; and including a refracting layer extending approximately perpendicular to a centerline of said slot at a location beyond said further end of said slot, said refracting layer being made of a material which is transmissive to and effects refraction of electromagnetic signals in a selected frequency range that travel in one of two opposite directions along said slot.

15. An apparatus according to claim 14, including a further layer which extends approximately perpendicular to said centerline of said slot and which is disposed adjacent said refracting layer on a side thereof remote from said slot, said further layer being made of a material which is transmissive to and effects refraction of the electromagnetic signals in said selected frequency range which are traveling in one of said two opposite directions along said slot.

16. An apparatus according to claim 15, wherein said refracting and further layers are respective portions of a radome.

17. An apparatus, comprising:

a conductive section having a recess which includes a balun portion and a slot portion, said slot portion communicating at one end with said balun portion, and having a further end remote from said one end thereof;

an elongate conductive element which extends generally transversely with respect to said slot portion in the region of said one end thereof; and a refracting layer extending approximately perpendicular to a centerline of said slot portion at a location beyond said further end of said slot portion, said refracting layer being made of a material which is transmissive to and effects refraction of electromagnetic signals in a selected frequency range that travel in one of two opposite directions along said slot.

18. An apparatus according to claim 17, including a further layer which extends approximately perpendicular to said centerline of said slot portion and which is disposed adjacent said refracting layer on a side thereof remote from said slot portion, said further layer being made of a material which is transmissive to and effects refraction of the electromagnetic signals in said selected frequency range which are traveling in one of said two opposite directions along said slot.

19. An apparatus according to claim 18, wherein said refracting and further layers are respective portions of a radome.

20. An apparatus according to claim 18, wherein said layers have dielectric constants which are different.

21. A method comprising the steps of:

creating in an electrically conductive layer a recess therein which includes a balun portion and a slot portion, said slot portion communicating at one end with said balun portion;

forming a dielectric layer adjacent one side of said conductive layer, said dielectric layer having an opening therethrough in the region of a further end of said slot portion remote from said one end thereof; and fabricating an elongate conductive element which extends generally transversely with respect to said slot portion in the region of said one end thereof.

22. A method according to claim 21, wherein said forming step is carried out in a manner so that said opening increases substantially progressively in width in a direction away from said one end of said slot portion.

23. A method comprising the steps of:

creating in an electrically conductive plate a balun hole and a slot that extends transversely therethrough, said slot opening at one end into said balun hole;

fabricating an elongate conductive element which extends generally transversely with respect to said slot in the region of said one end of said slot; and wherein said slot has edges on opposite sides thereof that each follow a predetermined curve other than a first-order exponental curve and that may be represened by a polynominal having an order greater than one.

24. A method according to claim 23, including the step of selecting a metal as the material from which said electrically conductive plate is made.

25. A method, comprising the steps of:

creating in a conductive section a recess which includes a balun portion and a slot portion, said slot portion communicating at one end with said balun portion, and having a further end remote from said one end thereof;

fabricating an elongate conductive element which extends generally transversely with respect to said slot portion in the region of said one end thereof; and forming a refracting layer which extends approximately perpendicular to a centerline of said slot portion at a location beyond said further end of said slot portion, said refracting layer being made of a material which is transmissive to and effects refraction of electromagnetic signals in a selected frequency range that travel in one of two opposite directions along said slot.

26. A method according to claim 25, including the step of forming a further layer which extends approximately perpendicular to said centerline of said slot portion and which is disposed adjacent said refracting layer on a side thereof remote from said slot portion, said further layer being made of a material which is transmissive to and effects refraction of the electromagnetic signals in said selected frequency range which are traveling in one of said two opposite directions along said slot.

27. An apparatus according to claim 1, wherein said opening facilitates impedance matching between said slot portion and a region disposed beyond said further end of said slot portion.

28. An apparatus according to claim 5, wherein said slot is free of dielectric material.

29. A method according to claim 21, wherein said step of forming said dielectric layer includes configuring said opening to facilitate impedance matching between said slot portion and a region disposed beyond said further end of said slot portion.

30. A method according to claim 23, including the step of omitting dielectric material within said slot.

31. An apparatus, comprising:

an electrically conductive plate having a balun hole and a slot extending transversely therethrough, said slot opening at one end into said balun hole;

an elongate conductive element which extends generally transversely with respect to said slot in the region of said one end of said;

wherein said conductive element has first and second ends, said conductive element being electrically coupled to said plate at said second end thereof, and being free of electrical contact with said plate from said first end thereof to a section thereof adjacent said second end thereof, said section of said conductive element being the portion thereof which extends generally transversely of said slot in the region of said one end of said slot;

including a dielectric sheath provided around said conductive element from said first end thereof past said section thereof; and including an electrically conductive shield provided around said sheath from said first end of said conductive element to a location adjacent said section thereof, said sheath being free of said section of said conductive element, and said shield being electrically coupled to said plate.

* * * * *

UNITED STATES PATENT AND TRADEMARK OFFICE

CERTIFICATE OF CORRECTION

PATENT NO. : 6,850,203 B1
APPLICATION NO. : 10/023800
DATED : February 1, 2005
INVENTOR(S) : Nicholas A. Schuneman et al.

It is certified that error appears in the above-identified patent and that said Letters Patent is hereby corrected as shown below:

On Title Page, References Cited, Other Publications, Page 2:
Column 2, Line 10, delete "COmpensation" and insert -- Compensation -- .

Column 3:
At Line 35, after "each other by a thin" delete "layer." and insert -- layer-- .

Column 11:
At Line 13, after "the left port has a voltage" delete "$V_x$" and insert -- $V_x$ -- and after "and current" delete "$I_x$" and insert -- $I_x$ -- .
At Line 14, after "port has a voltage" delete "$V_y$" and insert -- $V_y$ -- and after "and current" delete "$I_y$" and insert -- $I_y$ -- .
At Line 42, after "the balun hole" delete "49." and insert -- 49 -- .

UNITED STATES PATENT AND TRADEMARK OFFICE

CERTIFICATE OF CORRECTION

PATENT NO. : 6,850,203 B1
APPLICATION NO. : 10/023800
DATED : February 1, 2005
INVENTOR(S) : Nicholas A. Schuneman et al.

It is certified that error appears in the above-identified patent and that said Letters Patent is hereby corrected as shown below:

Column 13:
At Line 57, delete "length l" and insert -- length *l* --.

Column 14:
At Line 37, after "a respective" delete "[ABCD]matrix" and insert -- [ABCD] matrix -- .

Column 18:
At Line 64, after "coupled to the metal" delete "plate." and insert -- plate -- .

Column 24:
At Line 20, after "said sheath being free of said shield" insert -- in the region of -- .

Signed and Sealed this

Twenty-eighth Day of November, 2006

JON W. DUDAS
*Director of the United States Patent and Trademark Office*